US007147593B2

(12) United States Patent
Vittone

(10) Patent No.: US 7,147,593 B2
(45) Date of Patent: Dec. 12, 2006

(54) BALANCE APPARATUS FOR USE DURING AN EXERCISE ROUTINE

(76) Inventor: William M. Vittone, 127 Monticello Rd., Oak Ridge, TN (US) 37831

( * ) Notice: Subject to any disclaimer, the term of this patent is extended or adjusted under 35 U.S.C. 154(b) by 561 days.

(21) Appl. No.: 10/114,163

(22) Filed: Apr. 2, 2002

(65) Prior Publication Data

US 2003/0186794 A1 Oct. 2, 2003

(51) Int. Cl.
*A63B 26/00* (2006.01)

(52) U.S. Cl. ..... 482/142; 482/34; 482/146

(58) Field of Classification Search ..... 482/34, 482/146–7, 79–8, 80, 148, 907, 908, 142, 482/140, 147; D21/662, 685, 686
See application file for complete search history.

(56) References Cited

U.S. PATENT DOCUMENTS 5,049,079 A * 9/1991 Furtado et al. ..... 434/253
5,158,518 A * 10/1992 Pizzuto ..... 482/102
5,487,711 A * 1/1996 Little ..... 482/79
6,319,177 B1 * 11/2001 Levine ..... 482/100

* cited by examiner

*Primary Examiner*—Lori Amerson
(74) *Attorney, Agent, or Firm*—Luedeka Neely & Graham PC

(57) ABSTRACT

A balance apparatus for use during an exercise routine includes a frame and a platform having a surface against which the body of an individual is positioned or bears against during the performance of an exercise routine. The platform is pivotally connected to the frame to accommodate a pivoting of the platform relative to the frame about at least one pivot axis so that in order for the individual to maintain the platform in a balanced and stationary condition relative to the frame as he is positioned or bears against the platform, the individual must distribute any force which bears against the platform surface substantially evenly or equally about the at least one pivot axis.

3 Claims, 6 Drawing Sheets

BALANCE APPARATUS FOR USE DURING AN EXERCISE ROUTINE

BACKGROUND OF THE INVENTION

This invention relates generally to exercise apparatus for use during an exercise routine and relates, more particularly, to an exercise apparatus for use during the performance of an exercise routine so that the effectiveness of the routine is enhanced.

The class of exercise routine with which this invention is concerned commonly involves, but is not limited to, the movement of at least one limb of an individual between bent and extended conditions as a resistive force opposes the movements of the limb between the bent and extended conditions. For example, during the performance of a common squat-type exercise routine wherein the individual begins by standing upright upon a floor while supporting weights upon his shoulders, the individual repeatedly moves between the upright position at which his legs are straight and a squat position at which the legs are bent. Therefore, in the case of a squat-type exercise routine such as aforedescribed, the limbs to be moved between the bent and extended condition are the individual's legs, and the resistive force which opposes movement of the legs (i.e. from the bent condition toward the extended condition) includes the weights which are supported upon the individual's shoulders.

By comparison, during the performance of a common bench press-type exercise routine, an individual lies upon a workout bench and repeatedly moves his arms between a bent condition and an extended condition while holding a weight-laden barbell with his hands. Therefore, in the case of a bench press-type exercise routine such as aforedescribed, the limbs involved are the individual's arms, and the resistive force involved includes the weight-laden barbell held with the hands.

It is an object of the present invention to provide an apparatus for use during the performance of exercise routines of the aforedescribed class, which apparatus enhances the effectiveness of the exercise routine.

Another object of the present invention is to provide such an apparatus which strengthens muscles used by the individual for balance during the performance of an exercise routine.

Still another object of the present invention is to provide a balance apparatus upon which an individual stands or lies during the performance of an exercise routine.

Yet another object of the present invention is to provide such an apparatus which is uncomplicated in construction yet effective in operation.

SUMMARY OF THE INVENTION

This invention resides in a balance apparatus against which the body of an individual is positioned or bears against for the performance of an exercise routine.

The balance apparatus includes a frame and a platform having a surface against which the body of an individual is positioned or bears against for performance of an exercise routine. Furthermore, the platform is pivotally connected to the frame to accommodate a pivoting of the platform relative to the frame about at least one pivot axis through a limited number of angular degrees about the at least one pivot axis so that in order for the individual to maintain the platform in a balanced and stationary condition relative to the frame as he is positioned or bears against the platform, the individual must distribute any forces which bear against the platform surface substantially equally about the at least one pivot axis.

The balance apparatus is particularly well-suited for use during the performance of an exercise routine involving the movement of the limbs of an individual between bent and extended conditions as a resistive force opposes the movement of the limbs between the bent and extended conditions. In addition, embodiments of the balance apparatus can be used with or incorporated within an exercise machine which requires that the individual bear against a surface, such as a floor or workout bench, during the performance of an exercise routine. Further still, an existing exercise machine or workout bench can be modified, or retro-fitted, with features of the present invention to incorporate the balance apparatus within the existing exercise machine or bench.

DETAILED DESCRIPTION OF THE ILLUSTRATED EMBODIMENTS

Figure 1:
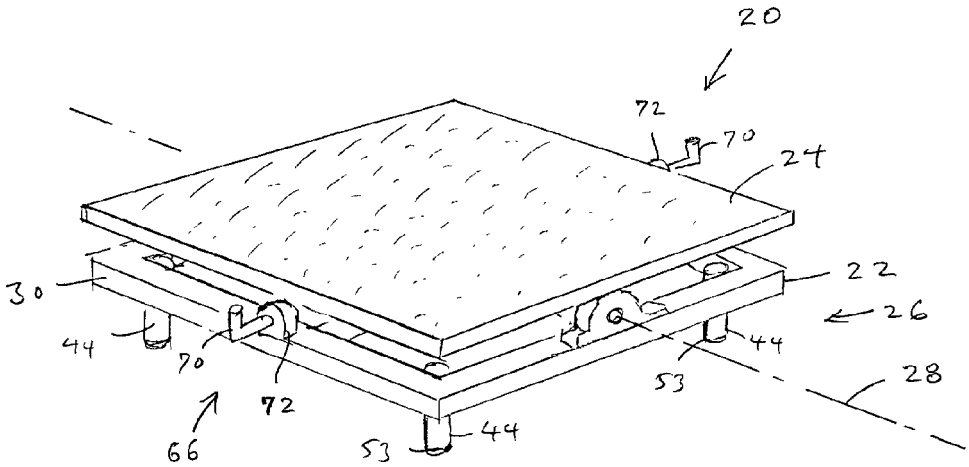
FIG. 1 is a perspective view of a balance apparatus within which features of the present invention are embodied.

Turning now to the drawings in greater detail, there is illustrated in FIG. 1 an embodiment of a balance apparatus, generally indicated 20, suitable for use, for example, during the performance of an exercise routine involving the movement of one limb or a pair of limbs of an individual between bent and extended conditions as resistive forces oppose the movements of the limbs between the bent and extended conditions. Briefly, the depicted apparatus 20 includes a frame 22, a platform 24 against which an individual positions himself for the performance of an exercise routine, and means, generally indicated 26 for pivotally attaching the platform 24 to the frame 22 to accommodate pivotal movement of the platform 24 from a balanced (e.g. horizontal) condition through a limited number of angular degrees about a pivot axis 28. Also included within the apparatus 20 are means, generally indicated 66, for releasably securing the platform 24 in a fixed condition relative to the frame 22 to thereby permit a user to selectively prepare the apparatus 20 for use in either a "released" condition in which the platform 24 is permitted to freely pivot relative to the frame 22 or a "locked" condition in which the platform 24 is fixed in a stationary condition relative to the frame 22.

In preparation of the apparatus 20 for use (while in its "released" condition), the individual positions himself upon the platform 24 so that the user's body (e.g. his torso) is disposed substantially centrally over the pivot axis 28 and so that the two shoulders of the individual are disposed on opposite sides of the pivot axis 28. If two of the individual's limbs (i.e. the limbs which are desired to be moved between bent and extended conditions) are to be exercised, then those two limbs are positioned on opposite sides of and substantially equidistant from the pivot axis 28. The individual then performs his exercise routine by urging his limbs to move between the bent and extended conditions in opposition to resistive forces which oppose the movement of the limbs from either the bent condition toward the extended condition or from the extended condition toward the bent condition. During the exercise routine, the individual attempts to maintain the platform 24 in a balanced (e.g. horizontal) condition about the pivot axis 28 by distributing his weight (and any other weight which is directed through his torso toward the platform 24) against the platform 24 so that the platform 24 is maintained in a balanced condition. As the individual attempts to maintain the platform 24 in the balanced condition, muscles of the individual are worked which would not otherwise be worked, and the apparatus 24 enhances the exercise routine in this respect.

Figure 2:
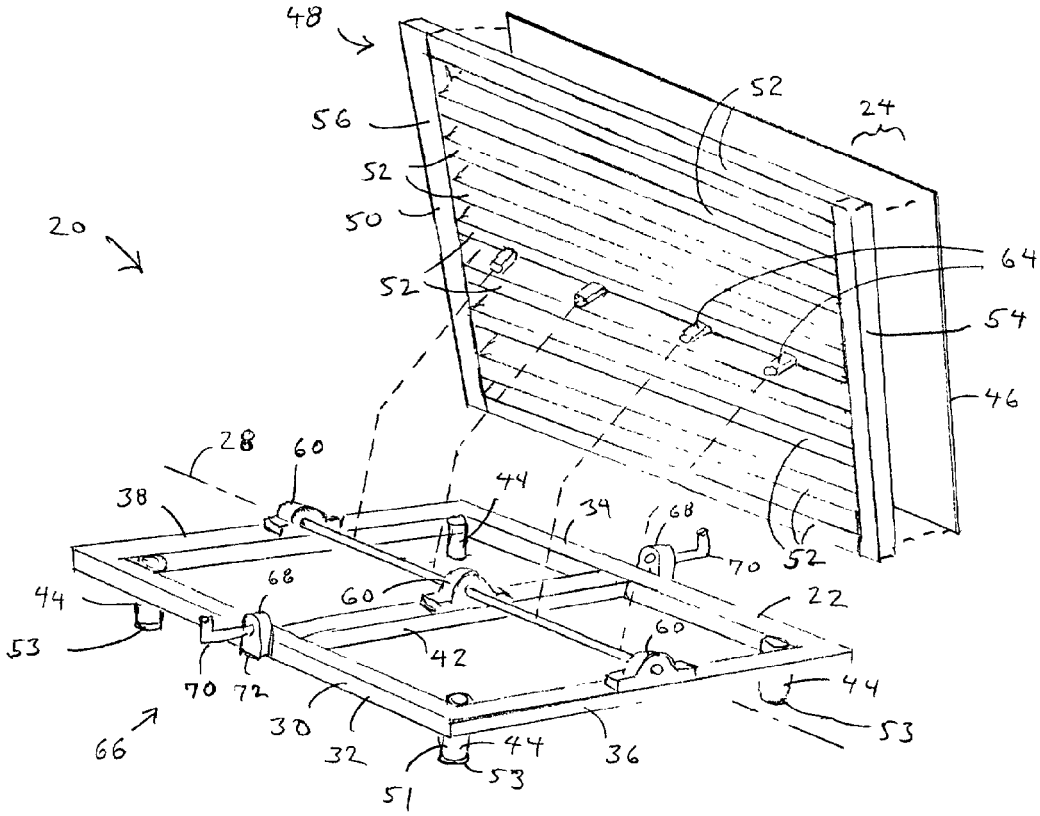
FIG. 2 is perspective view of the FIG. 1 balance apparatus, shown exploded.

With reference to FIG. 2, the frame 22 of the apparatus 20 includes a rectangular structure 30 having two parallel side members 32, 34 and parallel front and back members 36, 38 which are joined together, as with welds, at the corners of the structure 30. In addition, a central member 42 is positioned substantially midway between the front and back members 36, 38 and extends between and is joined to the side members 32, 34. Each of the side members 32, 34, front and back members 36, 38 and central member 42 is preferably constructed of steel channel having a rectangular cross section, although alternative materials can be used.

For supporting the structure 30 above the floor or similar underlying support surface, the frame 22 includes four foot members 44 joined, as with welds, at each of the four corners of the structure 30. Each of the foot members 44 can be provided, for example, by a section 51 of steel rod having its lower, floor-engaging, surface padded with a piece 53 of foam material. The foot members 44 are of equal length so that when the foot members 44 rest upon a floor, the structure 30 is substantially parallel with the floor.

With reference still to FIG. 2, the platform 24 of the depicted apparatus 20 includes a sheet of steel 46 and means for rigidifying 48 the steel sheet 46. The steel sheet 46 is rectangular in shape, and the rigidifying means 48 includes a platform frame 50 which backs and is attached to the sheet 46 along the perimeter thereof. In this connection, the frame 50 includes a plurality (e.g. nine) cross members 52 and a pair of end members 54, 56 joined, as with welds, across the ends of the cross members 52 to render the frame 50 rigid. The steel sheet 46 is, in turn, joined, as with welds, along the perimeter of the frame 50.

The means 26 for pivotally attaching includes a plurality of pillow blocks 60 which are supported by the frame 22 and a shaft 62 which is fixedly joined to the platform 24 and journalled within the pillow blocks 60. In the depicted apparatus 20, there are three pillow blocks 60 which are regularly spaced and attached, as with screws, to the central member 42 of the frame 22, and the shaft 62 is arranged parallel to the centralmost cross member 52 and attached thereto with struts 64 which extend between the shaft 62 and centralmost cross member 52. To permit the pivotal movement between the platform 24 and the frame 20, each pillow block 60 includes a bearing (e.g. either a sleeve bearing or a roller bearing), and the shaft 62 extends through the bearing of each pillow block 60 so that the shaft 62 is free to rotate about the pivot axis 28. For purposes of assembling the platform 24, the shaft 62 can be positioned through the pillow blocks 60 before the shaft 62 is secured to the platform frame 50 by way of the struts 64. To increase the useful life of the pillow blocks 60, each pillow block 60 is provided with bronze bushings and a grease fitting enabling the pillow blocks 60 to be occasionally greased.

Figure 3:
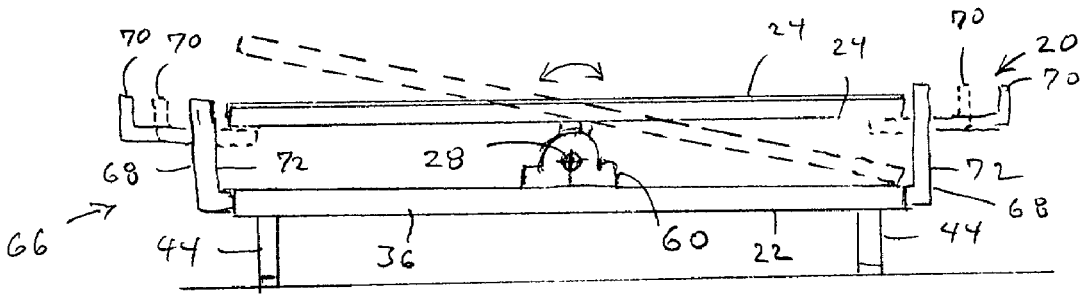
FIG. 3 is a front elevational view of the FIG. 1 balance apparatus.

With the platform 24 pivotally joined to the frame 22 as aforedescribed and with reference to FIG. 3, the platform 24 is capable of pivoting about the pivot axis 28 from a balanced condition of equilibrium (as illustrated in solid lines in FIG. 3) in either pivotal direction (i.e. either rightwardly or leftwardly as viewed in FIG. 3) to, for example, the position illustrated in phantom in FIG. 3. In the interests of the present invention, the platform 24 is in a "balanced condition" when the platform 24 is positioned in a stationary condition relative to the frame 22, but is free to move in either pivotal direction about its pivot axis 28. As can be seen in FIG. 3, when the platform 24 is positioned so that it is disposed substantially horizontal and thus substantially parallel with the underlying floor (and thus positioned in a "top dead center" position relative to the underlying pillow blocks 60), the platform 24 is permitted to be pivoted (rightwardly or leftwardly as viewed in FIG. 3) about the axis 28 from its "top dead center" balanced condition through a limited number of angular degrees before continued movement of the platform 24 is obstructed by the frame 22. In other words, following the pivotal movement of the platform 24 in either pivotal direction from the "top dead center" balanced condition through a limited number of angular degrees, the side edges of the platform 24 abut the frame 22 and are prevented from pivoting any further. As will be apparent herein, because the pivotal movement of the platform 24 about the pivot axis 28 is limited in this fashion, any risk of injury to an individual using the platform 24 is reduced.

Figure 4:
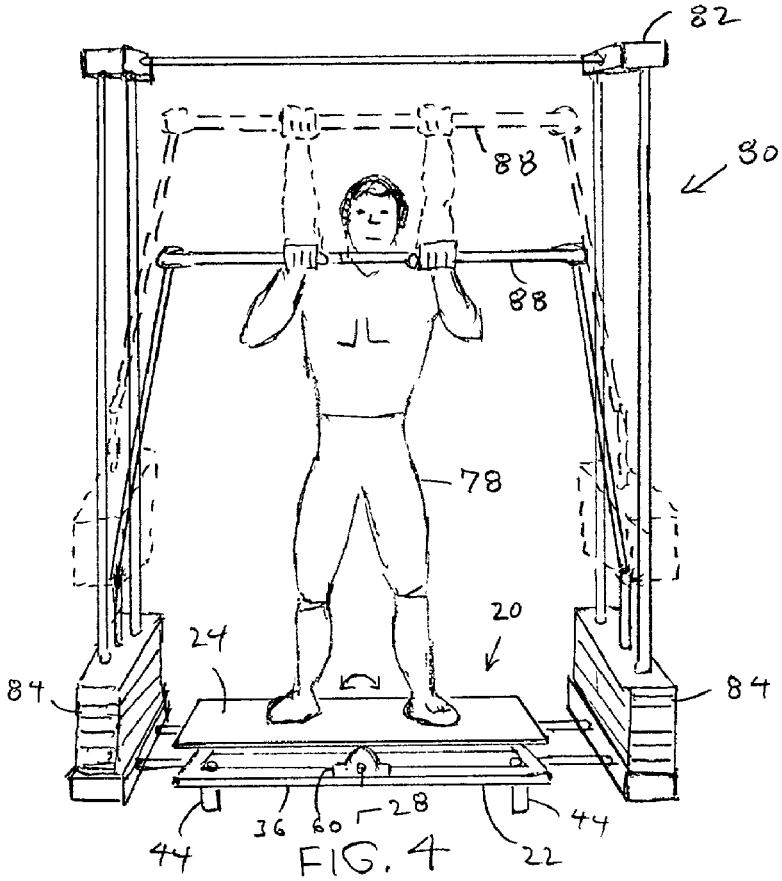
FIG. 4 is a perspective view of the FIG. 1 balance apparatus shown being used during the performance of a military press-type exercise routine.

With reference to FIG. 4, the balance apparatus 20 is shown positioned for use in conjunction with an exercise machine 80 used for the performance of a military press exercise routine involving the lifting of weights overhead with the arms while the individual performing the exercise maintains a standing position. For this exercise routine, the weight machine 80 includes a stationary frame 82, stacks of weights 84 positioned along a pair of guideways 86, and a lift bar 88 which is connected to the weights 84 in a manner enabling the weights 84 to be moved (i.e. raised and lowered) along the guideways 86 as the lift bar 88 is raised and lowered by the arms of the individual 78. In other words, the lift bar 88 is raised and lowered as the individual 78 moves his arms between bent and extended conditions as the weights 84 oppose the movement of the arms from the bent condition toward the extended condition. As is common with weight machines of this class, the individual 78 can select the amount of resistance to movement of his arms between the bent and extended conditions by selecting the amount of weight which is connected to the lift bar 88 for movement along the guideways 86 as the lift bar 88 is raised and lowered during an exercise routine. It follows that during an exercise routine of this type, the resistive forces which oppose movement of the arms between the bent and extended conditions are directed downwardly from the lift bar 88 through the torso of the individual 78.

In preparation of the balance apparatus 20 for use with the aforedescribed military press exercise machine 80, the apparatus 20 is positioned on the floor and is substantially centered with respect to the machine 80 so that the pivot axis 28 of the apparatus 20 is arranged substantially perpendicular to the downwardly-directed path of the resistive forces which oppose movement of the arms between the bent and extended conditions. Furthermore and inasmuch as the individual 78 normally stands within the machine 80 with his feet spread about shoulder-width apart for use of the machine 80, the pivot axis 28 is positioned so that when standing upon the platform 24, the feet of the individual 78 straddle and are spaced equidistant from the pivot axis 28. Consequently, the pivot axis 28 is centered beneath the lift bar 88 and is substantially perpendicular to a vertical plane which passes through the lift bar 88.

The individual 78 then stands upon the platform 24 in a ready position with his hands grasped about the lift bar 88 (and his arms in a bent condition) and so that his feet are positioned on opposite sides of and substantially equidistant from the pivot axis 28. The individual 78 then begins to repeatedly raise and lower the lift bar 88 as the weights 84 of the machine 80 resist the extension of the arms and consequently the movement of the arms from the bent condition toward the extended condition. It follows that during an exercise routine of this type, the resistive forces which oppose the upwardly-directed forces exerted upon the lift bar 88 are transferred downwardly to the platform by way of the individual's arms, torso, legs and feet.

Unless the side edges of the platform 24 are tipped (e.g. either rightwardly or leftwardly) far enough to engage the side edges of the frame 22 (as is illustrated in phantom in FIG. 3), the platform 24 is free to pivot relative to the frame 22 about the pivot axis 28 in either (e.g. a rightward or a leftward) pivotal direction. However, by distributing the downwardly-directed forces which are exerted upon the platform 24 (which would include the weight of the individual 78, as well as the resistive forces exerted downwardly through the individual's torso through the lift bar 88) substantially equally between the feet, the platform 24 is maintained in a balanced, substantially horizontal condition upon the frame 30. Unless, of course, such downwardly-directed forces are distributed equally between the feet, the platform 28 will pivot rightwardly or leftwardly about the pivot axis 28, and the individual 78 must re-distribute the downwardly-directed forces to achieve the desired balanced condition (i.e. the FIG. 3 solid-line position) of equilibrium. It follows that as the individual 78 seeks to maintain the proper distribution of downwardly-directed forces through his feet (and thereby maintain the platform in a balanced (e.g. horizontal) condition, the individual works muscles which may not otherwise be used during an exercise routine performed with the machine 80 without the apparatus 20. Consequently, the apparatus 20 enhances the benefits of an exercise routine performed with the machine 80, and the apparatus 20 is advantageous in this respect.

As mentioned earlier, the apparatus 20 also includes means, generally indicated 66 in FIGS. 1 and 2, for releasably securing the platform 24 in a fixed condition relative to the frame 22. Although the releasably-securing means 66 can take any of a number of forms, the releasably-securing means 66 of the depicted apparatus 20 includes a pair of locking mechanisms 68 each including a pin 70 and a boss member 72 attached to each side of the frame 22 on opposite sides of the pivot axis 28. Each pin 70 is slidably positioned within its corresponding boss member 72 for sliding movement between a release position, illustrated in solid lines in FIG. 3, at which the platform 24 is permitted to freely pivot about the pivot axis 28 as a corresponding side edge of the platform 24 moves past the boss member 72 and a secured position, illustrated in phantom in FIG. 3, at which the (inwardmost) end of the pin 70 protrudes through the boss member 72 and is thereby disposed between the frame 22 and the underside of the platform 24 so as to prevent the platform 24 from moving downwardly past the boss member 72. Therefore, when both pins 70 are moved to the secured position, the edges of the platform 24 is prevented by the pins 70 from moving upwardly or downwardly past the boss members 72 so that the platform 24 is thereby fixed in a stationary condition relative to the underlying frame 22. It will be appreciated that an individual who uses the apparatus 20 may not always wish that the platform 24 be permitted to pivot about the pivot axis 28 while he perform exercises upon the apparatus 20. Thus, the releasably-securing means 66 permits an individual to selectively prepare the apparatus 20 for use in either a "released" condition in which the platform 24 is permitted to freely pivot relative to the frame 22 or a "locked" condition in which the platform 24 is fixed in a stationary condition relative to the frame 22 by simply moving the pins 70 to the FIG. 3 release position or to the FIG. 3 secured position.

Figure 5:
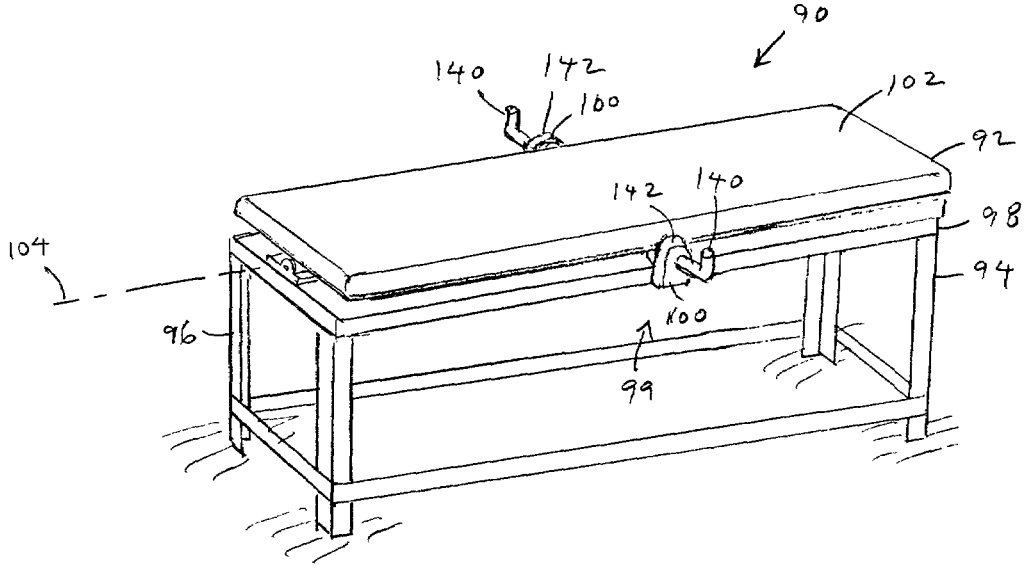
FIG. 5 is a view of a workout bench embodying a balance apparatus embodying features of the present invention.
Figure 6:
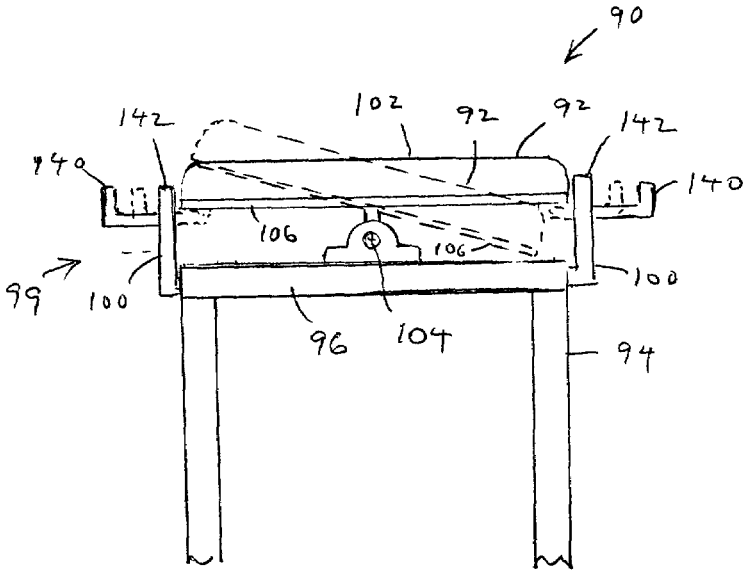
FIG. 6 is a front elevational view of a fragment of the FIG. 5 bench.
Figure 7:
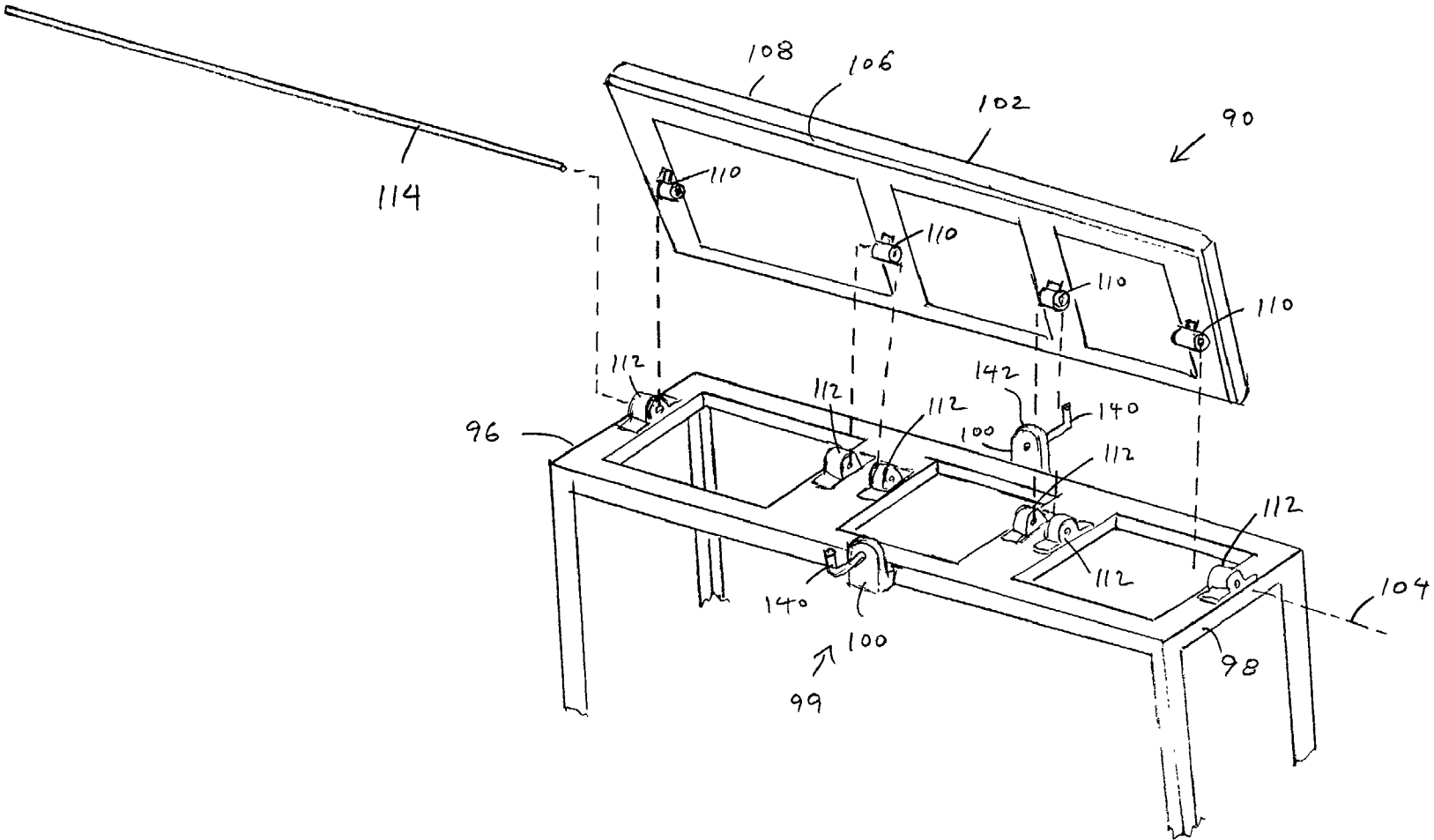
FIG. 7 is a perspective view of a fragment of the FIG. 5 bench, shown exploded.
Figure 8:
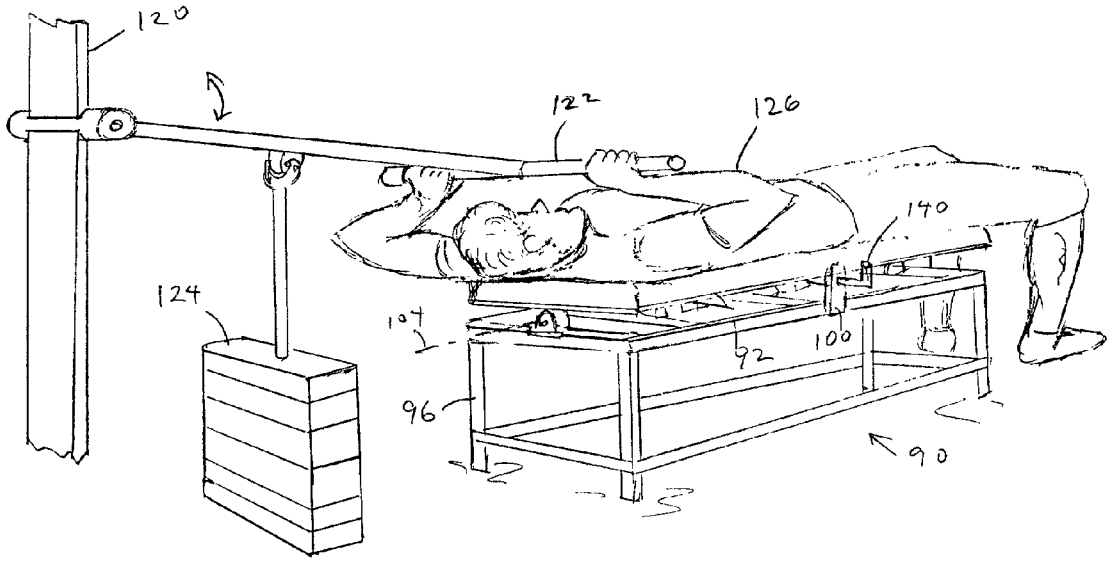
FIG. 8 is a perspective view of the FIG. 5 bench shown being used with an exercise machine during the performance of a bench press-type exercise routine.

Although the balance apparatus 20 of FIGS. 1–3 has been shown and described above as being used in conjunction with an exercise routine during which an individual, or user, stands upon the platform 24 of the apparatus 20, an embodiment of the apparatus can be used in conjunction with an exercise routine during which an individual lies down upon the apparatus so that his back is positioned upon (or against) the apparatus platform. For example, there is shown in FIGS. 5–7 a workout bench 90 within which a balance apparatus 92 is incorporated and which is particularly well-suited for use in conjunction with a bench press machine 120 (FIG. 8). The bench 90 includes a frame 94 having opposite head and foot portions 96, 98, respectively, and a platform section 102 which is pivotally connected to the remainder of the bench 90 for pivotal movement relative thereto through a limited number of angular degrees about a pivot axis 104 from a balanced condition.

In the bench 90 of FIGS. 5–7, the pivot axis 104 is arranged substantially horizontally and parallel to the longitudinal axis of the bench, and the balance apparatus 92 is in a balanced condition as shown in solid lines in FIG. 6 when the platform section 102 is arranged substantially horizontal and thus parallel to the underlying floor. Furthermore, the platform section 102 is permitted to pivot relative to the platform section 102 from the balanced (FIG. 6 solid-line) condition in either rotational direction (e.g. rightwardly or leftwardly) about the pivot axis 104. To this end and as best shown in FIG. 7, the platform section 102 includes a rigid underframe 106 overlain with an amount of padding 108 and having a plurality of bosses 110 extending along the length thereof, and the bench frame 94 includes a series of pillow blocks 112 having joined along the upper side of the frame 94. The pillow blocks 112 include bearing whose openings are aligned with one another along the pivot axis 104, and the bosses 110 have openings which are also aligned with one another along the pivot axis 104. A lengthy shaft 114 is inserted through and secured within the aligned openings of the pillow blocks 112 and bosses 110 to pivotally secure the platform section 102 to the frame 94 of the bench 90.

With reference again to FIG. 6, the platform section 102 is permitted to pivot (rightwardly or leftwardly) relative to the frame 94 from the balanced (FIG. 6 solid-line) condition of balance through a limited number of angular degrees before the side edges of the underframe 106 of the platform section 102 abut the side edges of the frame 94 thereby preventing further pivotal movement of the platform section 102 in the rightward or leftward pivotal direction. In the depicted bench 90, pivotal movement of the platform section 102 about the pivot axis 104 relative to the remainder of the bench 90 is prevented beyond about fifteen degrees.

To releasably secure the platform section 102 in its horizontal position to, for example, fix the position of the platform section 102 relative to the remainder of the bench 90 for exercise routines performed with a standard workout bench (whose upper surface is fixed in position with respect to the underlying frame of the bench), the bench 90 is provided with releasably-securing means 99 (best shown in FIG. 9) including a pair of locking mechanisms 100 each including a pin 140 and a boss member 142 attached to a corresponding side of the bench frame 94. As are the pins 70 of the locking mechanism 68 of the apparatus 20 of FIGS. 1–3, the pins 140 of the locking mechanisms 100 are slidably positioned within the boss members 142 for movement between a release position, as illustrated in solid lines in FIG. 6, and a secured position, as illustrated in phantom in FIG. 6, at which the (inwardmost) end of the pin 140 prevents the corresponding side edge of the platform section 102 downwardly past the boss members 142. Consequently, when both of the pins 140 are positioned in the secured position, the platform section is fixed in a stationary condition relative to the underlying frame 94.

With reference to FIG. 8, the bench 90 is shown positioned adjacent the bench press machine 120 for use therewith. In particular, the bench press machine 120 includes a lift bar 122 and a stack of weights 124 which are joined to the lift bar 122 for movement therewith as the lift bar 122 is raised from a position of rest and subsequently returned, or lowered, to the position of rest. To use the bench 90 with the machine 120, the bench 90 is positioned adjacent the machine 120 so that the head portion 96 of the frame 94 is disposed beneath the lift bar 122 so that an individual, indicated 126 in FIG. 8, who lies upon the bench 90 with his shoulders positioned directly beneath the lift bar 122 is in position for urging the bar 122 upwardly from its position of rest with his arms.

When the individual 126 lies upon (and thus bears against) the bench 90, his back rests upon the platform section 102 so that his shoulders are positioned equidistant from the pivot axis 104. With the shoulders positioned relative to the pivot axis 104 in this manner, the individual can begin to raise and lower the lift bar 122 while attempting to maintain the platform section 102 in its balanced (e.g. horizontal) condition. To maintain the platform section 102 in this condition of balance, the individual 126 must distribute his weight (including the force of the weights directed through his torso by way of the lift bar 122) through his back and shoulders so that substantially the same amount of downward force is applied on opposite sides of, and thus evenly about, the pivot axis 104. To distribute his weight in this manner and thereby maintain the platform in a balanced, substantially horizontal, condition, the individual 126 must utilize muscles which might not otherwise be worked during the performance of a bench press exercise routine.

It will be understood that numerous modifications and substitutions can be had to the aforedescribed embodiments without departing from the spirit of the invention. For example, although the platforms of the aforedescribed embodiments 20 and 92 are adapted to pivot about a single, horizontally-disposed pivot axis and are intended to oppose the force of weights directed against the apparatus platforms from space above the platforms, an apparatus in accordance with the broader aspects of the invention can have an alternately-disposed pivot axis and can be constructed to oppose forces directed thereagainst from alternative directions.

For example, an inclined bench can include an appropriately-constructed balance section whose platform section has a pivot axis which is oriented at an angle with respect to the horizontal, and a balance apparatus (whose construction is similar to that of the apparatus 20 of FIGS. 1–3) can be mounted vertically, as upon a wall, so that the pivot axis of the apparatus platform is oriented vertically and so that the platform is arranged to oppose the weight (or the forces of weights pressing thereagainst) of an individual whose back is pressed against the platform section.

Figure 9:
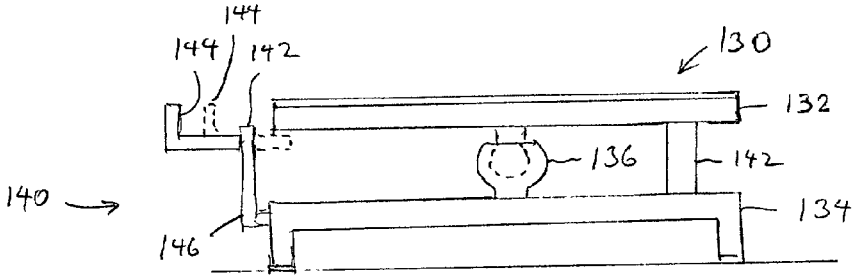
FIG. 9 is a front elevational view similar to that of FIG. 3 of another embodiment of a balance apparatus in accordance with the present invention.
Figure 10:
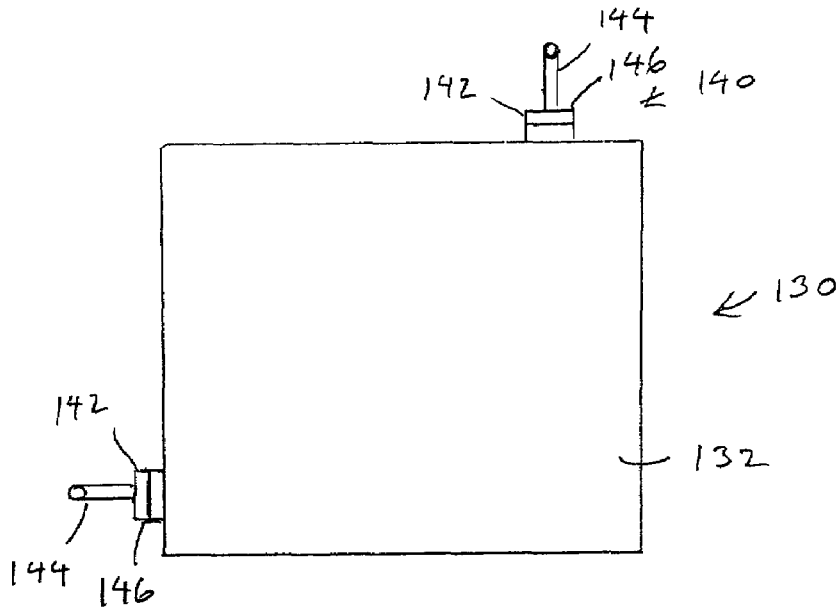
FIG. 10 is a plan view of the FIG. 9 embodiment.

Still further, as an alternative to a linear pivot axis, embodiments of the present invention can have platforms which are attached to a frame with, for example, a universal joint or a ball joint to accommodate a pivoting of the platform in any number of pivotal directions. With reference to FIGS. 9 and 10, there is illustrated an embodiment of such a balance apparatus, generally indicated 130, including a platform 132 which is pivotally secured to an underlying frame 134 by way of a ball joint assembly 136. Because the ball joint assembly 136 accommodates, or permits, the platform 132 to pivot in any number of directions (e.g. rightwardly, leftwardly, forwardly, or rearwardly) relative to the frame 134, the number of pivot axes about which the platform 132 can pivot is infinite.

The embodiment 130 of FIGS. 9 and 10 also includes means, generally indicated 140, for releasably securing the platform 132 in a fixed, or stationary, position relative to the underlying frame 134. Since the platform 132 (when in a released condition) is capable of being pivoted relative to the frame 134 about the ball joint assembly 136 in any of a number of directions, the releasably-securing means 140 includes a multiple (i.e. at least two) of locking mechanisms 142 (complete with a slidable pin 144 and boss member 146 similar in structure and function to the earlier-described locking mechanisms 68 and 100) which are spaced at appropriate positions along the perimeter of the platform 132 so that by slidably moving the pins 144 of every locking member 140 inwardly to the secured position (to for example the phantom-line position depicted in FIG. 9), the platform 132 is prevented from moving (e.g. pivoting upwardly or downwardly) in any direction about the ball joint assembly 136.

Further still, although the aforedescribed embodiments 20 and 92 have been shown and described as being independent components which are capable of being used with weight machines, apparatus in accordance with the broader aspects can be incorporated within such machines. For example, the apparatus 20 of FIGS. 1–3 can be secured in place within the weight machine 80 of FIG. 4 and thereby become an integral component of the weight machine. In this regard, applicant has incorporated a balance apparatus, such as the apparatus of FIGS. 1–3, into the platform of a squat machine described in U.S. Pat. No. 5,569,133, the disclosure of which is incorporated herein by reference. Thus, existing weight machines can be modified, or retro-fitted, to incorporate a balance apparatus embodying features of the present invention to provide the existing weight machine with a balance apparatus whose platform is capable of pivoting about an axis.

Figure 11:
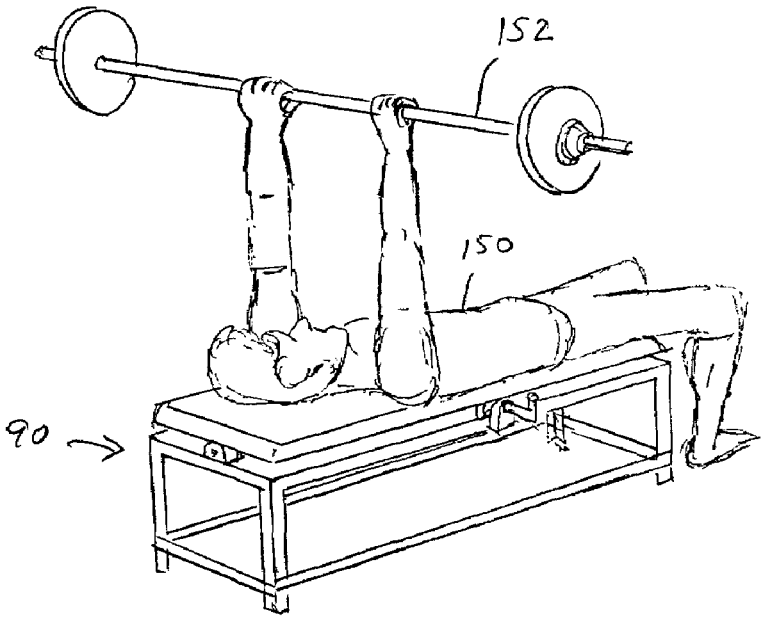
FIG. 11 is a perspective view of the FIG. 5 bench shown being used with a standard barbell during the performance of a bench press-type exercise routine.

Further still, although the aforedescribed balance apparatus 20 of FIGS. 1–3 and the workout bench 90 of FIGS. 5–7 have been shown and described above as being well-suited for use in conjunction with weight machines (e.g. of FIGS. 4 and 8) having weights whose movements are confined along predetermined paths as the user moves a bar in a prescribed direction, the aforedescribed apparatus 20 and the workout bench 90 is also well-suited for use with free weights, i.e. weights whose movements are not confined along a predetermined path. For example, there is illustrated in FIG. 11 the workout bench 90 shown being used by a individual 150 in conjunction with a bench press exercise routine involving a barbell 152. Accordingly, the aforedescribed embodiments are intended for the purpose of illustration and not as limitation.

The invention claimed is:

1. A balance apparatus against which the body of an individual bears against for the performance of an exercise routine involving the movement of a pair of limbs of the individual between bent and extended conditions in opposition to resistive forces directed along a path extending substantially through the body of the individual, the balance apparatus comprising:

a frame, a platform having a surface against which the body of the individual bears against for the performance of an exercise routine; and means for pivotally connecting the platform to the frame to accommodate a pivoting of the platform relative to the frame through a limited number of angular degrees about at least one pivot axis which is substantially perpendicular to the path of forces bearing against the platform surface by way of the body of the individual so that in order for the individual to maintain the platform in a balanced and stationary condition relative to the frame as he bears against the platform surface; the individual must distribute any forces which bear against the platform surface by way of his body substantially evenly about the at least one pivot axis; and means for releasably securing the platform in a stationary position relative to the frame.

2. A balance apparatus as defined in claim 1 wherein the means for releasably securing includes at least one locking mechanism wherein each locking mechanism includes a pin which is mounted for movement between a release position at which the pin does not obstruct movement of the platform relative to the frame and a secured position at which the pin obstructs movement of the platform relative to the frame.

3. An exercise machine including a frame and a balance section against which the body of an individual bears against for the performance of an exercise routine with the machine wherein the exercise routine involves the movement of a pair of limbs of the individual between bent and extended conditions in opposition to resistive forces directed along a path extending substantially through the body of the individual, the balance section comprising:

a platform having a surface against which the body of the individual bears against for the performance of an exercise routine performed with the machine; and means for pivotally connecting the platform to the frame of the machine to accommodate a pivoting of the platform relative to the frame through a limited number of angular degrees about at least one pivot axis which is substantially perpendicular to the path of forces bearing against the platform surface by way of the body of the individual so that in order for the individual to maintain the platform in a balanced and stationary condition relative to the frame as he bears against the platform surface during the performance of an exercise routine, the individual must distribute any forces which bear against the platform surface by way of his body substantially evenly about the at least one pivot axis; and means for releasably securing the platform in a stationary position relative to the frame.

* * * * *